US011814092B2

(12) United States Patent
Jovenall et al.

(10) Patent No.: US 11,814,092 B2
(45) Date of Patent: Nov. 14, 2023

(54) INCREASING FUNCTIONAL SAFETY OF LOCOMOTIVES

(71) Applicant: Cattron North America, Inc., Warren, OH (US)

(72) Inventors: Jeremy Jovenall, Mercer, PA (US); Jeremy R. Pearson, Fallbrook, CA (US)

(73) Assignee: Cattron North America, Inc., Warren, OH (US)

( * ) Notice: Subject to any disclaimer, the term of this patent is extended or adjusted under 35 U.S.C. 154(b) by 113 days.

(21) Appl. No.: 17/715,205

(22) Filed: Apr. 7, 2022

(65) Prior Publication Data

US 2022/0324495 A1 Oct. 13, 2022

Related U.S. Application Data

(60) Provisional application No. 63/172,896, filed on Apr. 9, 2021.

(51) Int. Cl.

| | |
|---|---|
| ***B61L 3/00*** | (2006.01) |
| ***B61L 15/00*** | (2006.01) |
| ***B61C 17/12*** | (2006.01) |

(52) U.S. Cl.

CPC ..... *B61L 3/006* (2013.01); *B61C 17/12* (2013.01); *B61L 15/0072* (2013.01)

(58) Field of Classification Search

CPC .... B61L 3/006; B61L 3/04; B61L 3/08; B61L 3/127; B61L 15/0072

See application file for complete search history.

(56) References Cited

U.S. PATENT DOCUMENTS

| | | | | |
|---|---|---|---|---|
| 5,564,657 | A | 10/1996 | Dimsa et al. | |
| 11,022,971 | B2 * | 6/2021 | Della Penna | G08G 1/0112 |
| 2016/0009304 | A1 * | 1/2016 | Kumar | B61L 27/40 701/19 |
| 2019/0176862 | A1 * | 6/2019 | Kumar | B61L 15/0081 |
| 2022/0063689 | A1 * | 3/2022 | Kumar | B61L 15/0072 |

OTHER PUBLICATIONS

Control Stand; https://en.wikipedia.org/w/index.php?title=Control_stand&oldid=1081685025; Apr. 9, 2022, 2 pages.

LCS-III Locomotive Control System Data Sheet; Cattron.com; Aug. 2021; 2 pages.

* cited by examiner

*Primary Examiner* — John Kwon

(74) *Attorney, Agent, or Firm* — Harness, Dickey & Pierce, P.L.C.; Anthony G. Fussner

(57) ABSTRACT

The present disclosure generally relates to systems and methods of increasing functional safety of locomotives. In exemplary embodiments, a locomotive functional safety system is configured to: receive one or more manual control commands from a locomotive control stand and/or a user interface onboard a locomotive; determine whether the one or more manual control commands pass or satisfy one or more predetermined criteria; if the one or more manual control commands pass or satisfy the one or more predetermined criteria, approve the one or more manual control commands and allow the one or more manual control commands to be relayed onward and/or acted upon; and if the one or more manual control commands do not pass or satisfy the one or more predetermined criteria, disapprove the one or more manual control commands and disallow the one or more manual control commands to be relayed onward and/or acted upon.

24 Claims, 4 Drawing Sheets

INCREASING FUNCTIONAL SAFETY OF LOCOMOTIVES

CROSS-REFERENCE TO RELATED APPLICATION

This application claims the benefit of and priority to U.S. Provisional Patent Application Ser. No. 63/172,896 filed Apr. 9, 2021. The entire disclosure of this provisional patent application is incorporated herein by reference.

FIELD

The present disclosure generally relates to systems and methods of increasing functional safety of locomotives.

BACKGROUND

This section provides background information related to the present disclosure which is not necessarily prior art.

Remote control locomotive (RCL) operation has a proven effect on safety and productivity over more than twenty years since RCL operation was accepted for regulated railroads in the USA. Despite this improvement, RCL operation has not been universally or completely adopted by all railroad companies.

DRAWINGS

The drawings described herein are for illustrative purposes only of selected embodiments and not all possible implementations and are not intended to limit the scope of the present disclosure.

Corresponding reference numerals may indicate corresponding (but not necessarily identical) parts throughout the several views of the drawings.

DETAILED DESCRIPTION

Figure 1:
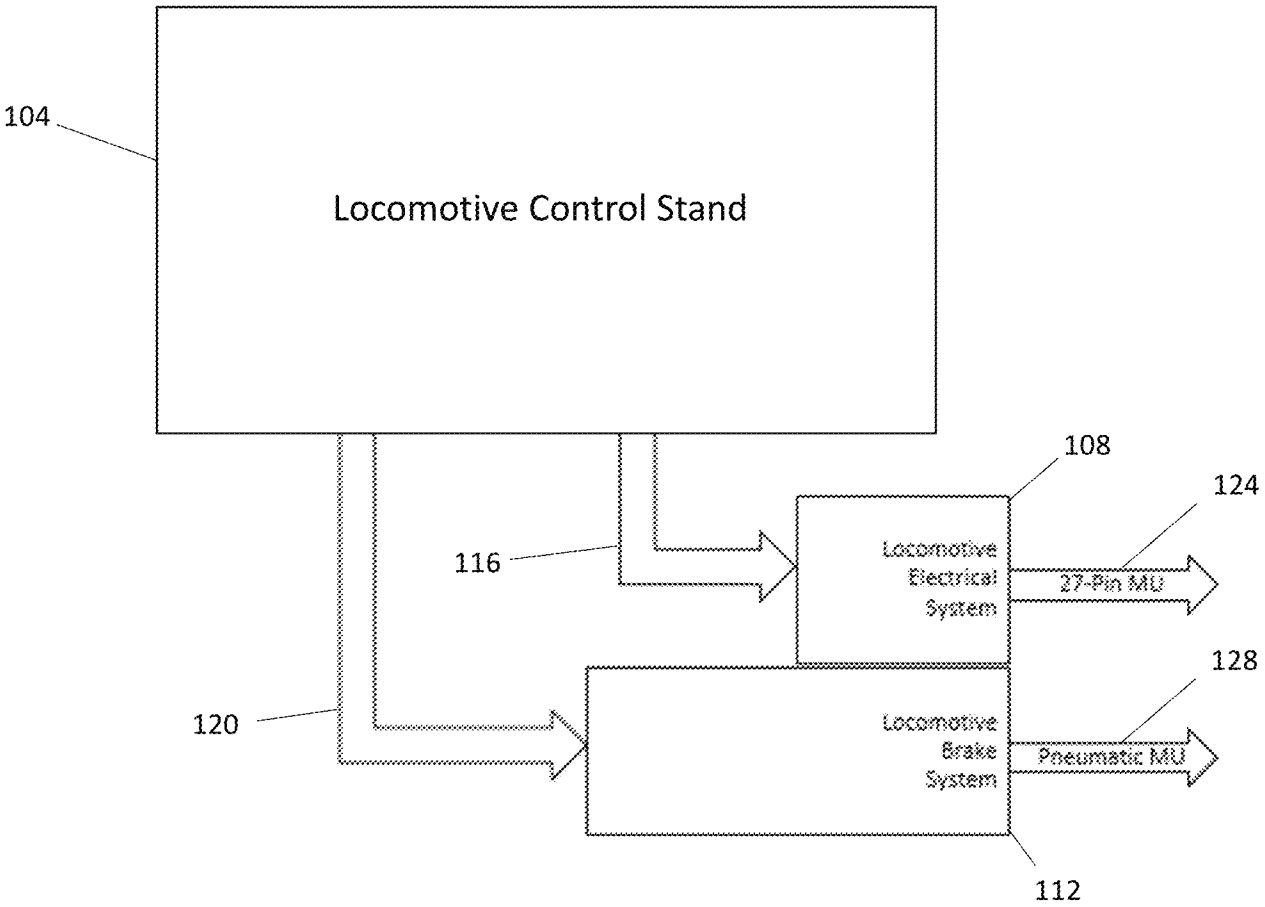
FIG. 1 illustrates a conventional layout for non-RCL (manual) locomotive operations in which a locomotive control stand is in direct communication with a locomotive electrical system and a locomotive brake system.

Example embodiments will now be described more fully with reference to the accompanying drawings.

Disclosed herein are exemplary embodiments in which safety and productivity features that have benefited RCL operation of the freight rail industry are implemented, incorporated, and/or provided in non-RCL (manual) locomotive operations, e.g., in freight yard switching, etc. Advantageously, safety enhancements and productivity improvements currently associated to RCL operation may therefore be provided for non-RCL (manual) locomotive operations without complete remote control adoption.

As disclosed herein, an exemplary embodiment of a locomotive functional safety system (broadly, a system) is configured to intercept, interpret, and approve or disapprove manual commands from a locomotive engineer (broadly, a user). The locomotive functional safety system is configured to act only on the manual commands (broadly, user input) from the locomotive engineer that pass various firmware functions that regulate safety. The locomotive functional safety system is configured to receive the user input from the locomotive control stand and/or user interface, and then apply rules and safety functions to determine which commands get relayed onward, e.g., to trainline signals, actuators, other train systems, etc. The locomotive functional safety system may be configured to have direct control over trainline throttle, reverser, and generator field signals, and trainline pneumatic lines.

In an exemplary embodiment, the locomotive functional safety system includes and/or communicates with a user interface (e.g., user interface 136 (FIG. 3), user interface 236 (FIG. 4), etc.). The user interface is suitable for mounting on or installation onto a locomotive control stand. The locomotive control stand may generally include engine functional controls, brake functional controls (e.g., automatic brake lever, independent brake level, dynamic brake control, etc.), throttle control, reverser, radio controls, light controls, multiple displays (e.g., main reservoir display, brake cylinder/brake pipe display, brake pipe flowmeter/air gauge display, loadmeter display, etc.), etc.

The user interface may include lights (e.g., light emitting diodes (LEDs), etc.), text feedback, other indicators, etc. for providing information to the user. The user interface may also include a cutover switch to enable and disable the system's protective features. An electronic switch interface may be provided for the user to input brake or speed commands.

The locomotive functional safety system may generally include input/output (I/O), processing, IIoT (Industrial Internet of Things) subsystems, etc. In an exemplary embodiment, the locomotive functional safety system includes a cutover subsystem, an input subsystem, a processing subsystem, an output subsystem, and a self-monitoring subsystem.

The cutover subsystem is configured to be installed to remove direct control from the electric/electronic control stand signals and pneumatic or electronic brake system. The cutover subsystem is configured to route the control through the locomotive functional safety system.

The input subsystem is configured to read the inputs from the user interface, electric/electronic signals from the locomotive control stand, and digital inputs and analog inputs indicating the state of the various user input and feedback points on the locomotive. The input subsystem is configured to forward the inputs to the processing subsystem.

The processing subsystem includes safety overrides, firmware functions, and watchdogs to read various inputs and to validate and process the various inputs through various rules based on user input, system location, feedback data, and predetermined configuration settings. The processing subsystem is configured to store inputs, outputs, and system events in an archive.

The processing subsystem is also configured to determine which commands can be forwarded to an output subsystem while complying with the safety rules established for the locomotive functional safety system. The output subsystem is configured to receive approved output commands from the processing subsystem and to activate electrical, electronic, pneumatic, or mechanical actuators in accordance with the commands from the processing subsystem.

The self-monitoring subsystem comprises portions of the other subsystems. The self-monitoring subsystem is configured to monitor the health of the complete locomotive functional safety system. The self-monitoring subsystem is also configured to monitor health of key parts of the complete locomotive. Beneficially, the system may therefore monitor functions for correspondence that would currently require observation by the locomotive engineer for detection.

The locomotive functional safety system may also include an optional subsystem that is configured to send the recorded archive data from the locomotive functional safety system to a remote server, etc. for the purpose of aggregating data, generating reports, trends, location updates and alerts, all of which may provide productivity, maintenance, and usage insights for users to access on a computer, smart phone, tablet, etc. This data may be shown in aggregate with other devices such as RCL systems, OCUs (Operator Control Units) for RCL, various yard vehicles, etc. to provide greater insight to the current or historical state of the yard and yard operations.

Pullback and Stopping Protection (PSP) and speed limiting function are two examples of safety and productivity functions that may be provided for non-RCL (manual) locomotive operations in exemplary embodiments disclosed herein. Regarding Pullback and Stopping Protection (PSP), a predetermined section of track may have a stopping trajectory defined to prohibit movement of equipped rolling stock beyond a certain point. The PSP system onboard the locomotive may be configured to receive data from geofences, track transponders, an internally stored digital map, and intelligent video or other signals used to enact a declining speed limit to force a stop prior to the protected location.

For the speed limiting function, the locomotive may have a configurable speed limit that is applied in all locations or conditionally applied depending on geographic location and/or direction of travel (heading). The speed limit is enacted by selectively limiting throttle commands from the user input from being forwarded to the output subsystem and/or applying braking effort that is not commanded by the user with respect to the speed feedback.

Various safety improvements may be provided by a locomotive functional safety system in exemplary embodiments such as requiring two-step commands to release brakes or command a movement; monitoring the state of commanded outputs to verify that the locomotive subsystems are functioning properly; automating manual tasks such as full service brake commands, which typically require multiple steps from the operator, into single action commands; train brake cycle braking protection, where the protective system monitors the state of charge of the train brake and can inform the operator of the current state and/or prevent the operator from misusing the train brake by overriding to force a more restrictive brake command if the state of charge is not sufficient to command the braking effort requested by the operator; automate safety-related procedures such as activation of horn and/or bell when approaching or occupying grade crossings; and various other functions typically associated to RCL operation.

Advantageously, exemplary embodiments disclosed herein may enable safety and productivity features that were previously only available on RCL systems to be available for use on locomotives not completely equipped with RCL.

With reference now to the figures, FIG. 1 illustrates a conventional layout for non-RCL (manual) locomotive operations in which a locomotive control stand 104 is in direct communication with a locomotive electrical system 108 and a locomotive brake system 112. Accordingly, manual commands input by a locomotive engineer into the locomotive control stand 104 are output from the locomotive control stand 104 along one-way communication pathways 116, 120 directly to the locomotive electrical system 108 and the locomotive brake system 112. Also shown in FIG. 1 are a 27-pin multiple unit (27-Pin MU) connector 124 for conveying locomotive functions from the locomotive electrical system 108, and a pneumatic multiple unit connections (Pneumatic MU) 128 for conveying locomotive functions from the locomotive brake system. The pneumatic MU connections (hoses) are main reservoir, air reservoir, independent apply and release pipe, actuating pipe, and brake pipe.

Figure 2:
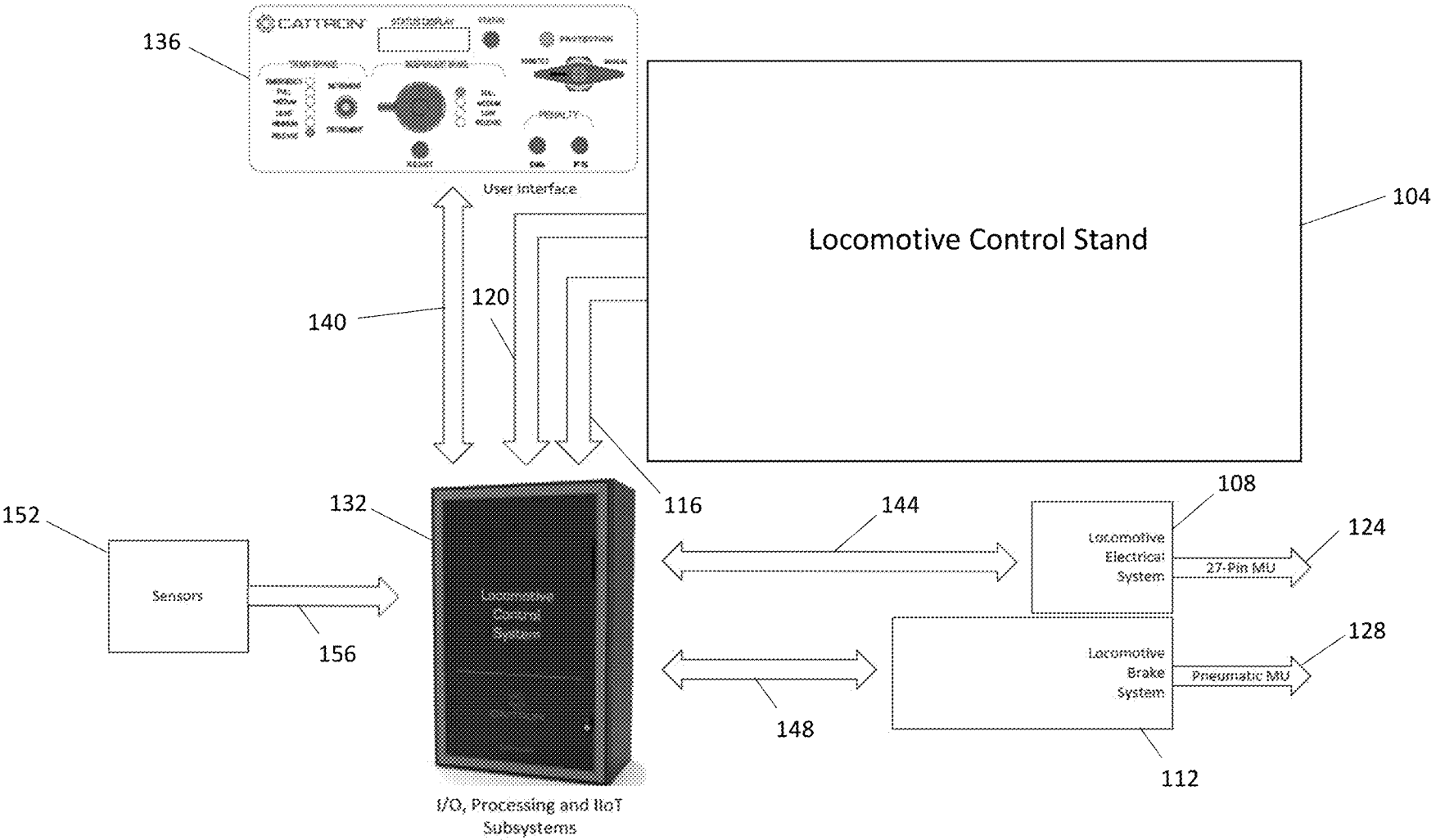
FIG. 2 illustrates a locomotive functional safety system installed generally between a locomotive control stand and a locomotive electrical system and locomotive brake system according to an exemplary embodiment of the present disclosure.

FIG. 2 illustrates a locomotive functional safety system 132 installed generally between the locomotive control stand 104 and the locomotive electrical system 108 and locomotive brake system 112 according to an exemplary embodiment of the present disclosure. The locomotive functional safety system 132 is configured to intercept manual commands output from the locomotive control stand 104 via the one-way communication pathways 116, 120. The locomotive functional safety system 132 is also configured to intercept manual commands output from the user interface 136 via a two-way communication pathway 140. As disclosed herein, the locomotive functional safety system 132 is configured to interpret the manual commands from the locomotive control stand 104 and user interface 136 and to act only on the manual commands that pass or satisfy various firmware functions that regulate safety.

The locomotive functional safety system 132 may send electrical system command data to the locomotive electrical system 108 along two-way communication pathway 144 when the electrical system command data passes or satisfies various firmware functions that regulate safety. In response to the receipt of the electrical system command data from locomotive functional safety system 132, the locomotive electrical system 108 may then send commands or instructions via the 27-pin multiple unit (27-Pin MU) connector 124.

The locomotive functional safety system 132 may also send brake system command data to the locomotive brake system 112 along two-way communication pathway 148 when the brake system command data passes or satisfies various firmware functions that regulate safety. In response to the receipt of the brake system command data from locomotive functional safety system 132, the locomotive brake system 112 may then send commands or instructions via the pneumatic multiple unit connector (Pneumatic MU) 128.

The firmware functions that regulate safety may comprise firmware of the locomotive functional safety system 132. For example, the firmware functions that regulate safety may comprise software programmed into memory (e.g., read-only memory (ROM), flash ROM, etc.) of the locomotive functional safety system 132. Alternatively, the firmware functions that regulate safety may comprise firmware on one or more other or additional locomotive system components.

To determine whether the received manual commands pass or satisfy firmware functions that regulate safety, the locomotive functional safety system 132 may rely upon sensor data. As shown in FIG. 2, sensor data from the sensors 152 may be provided to the locomotive functional safety system 132 via the one-way communication pathway 156. By way of example, the sensors 152 may include sensors for air pressure, air flow, speedometer, digital inputs, analog inputs, GNSS, RFID, etc. The sensors 152 may include sensors that provide data relating to geofences, track transponders, internally stored digital maps, intelligent video, or other signals used to enact a declining speed limit to force a stop prior to the protected location, etc. Depending on the particular sensors, the communication pathway 156 (and other communication pathways disclosed herein) may comprise a wired communication pathway and/or wireless communication pathway.

Figure 3:
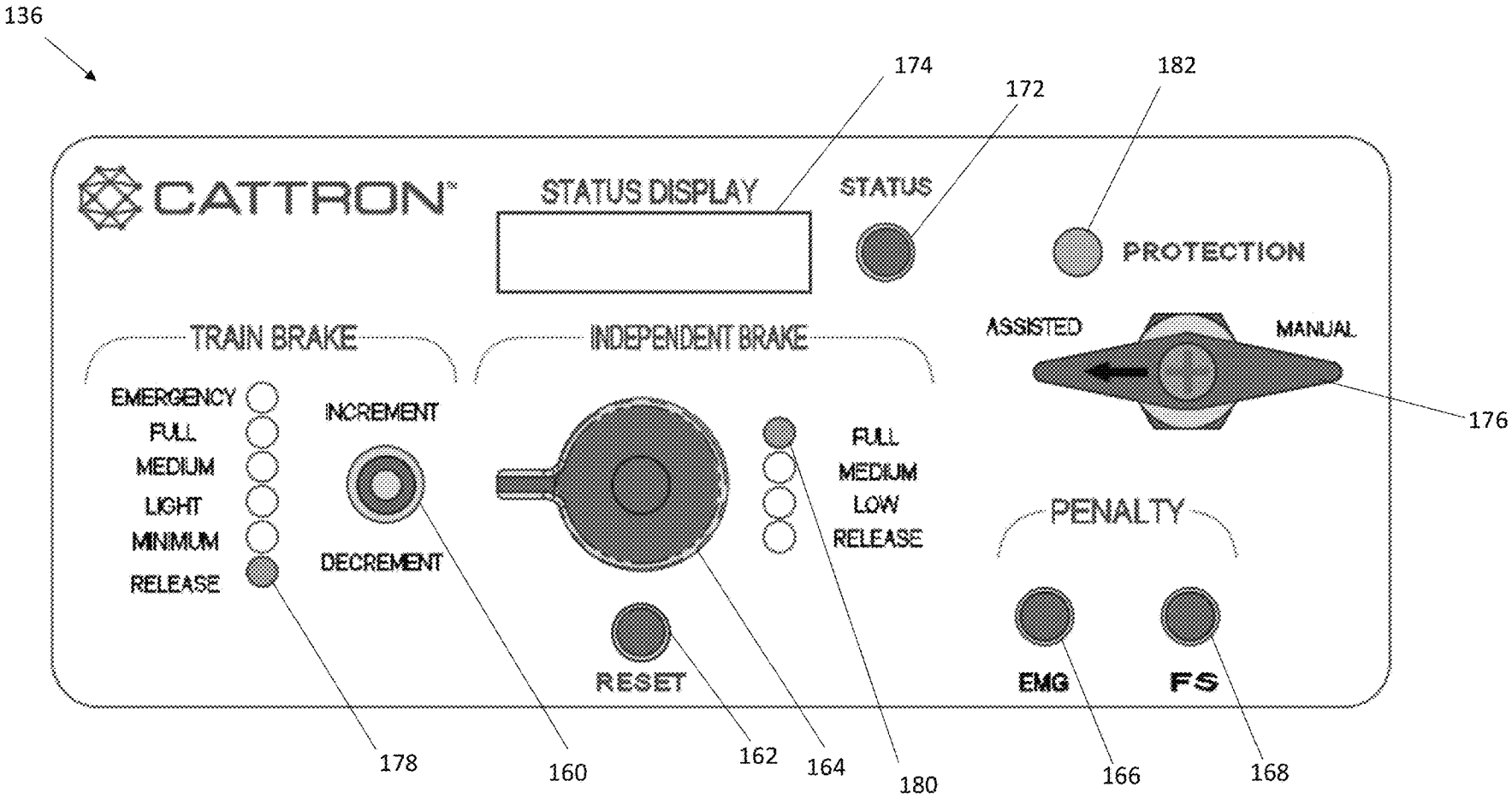
FIG. 3 illustrates the throttle/brake version of the user interface that is being used with the locomotive functional safety system shown in FIG. 2.

FIG. 3 illustrates the throttle/brake control version of the user interface 136 used with the locomotive functional safety system 132 shown in FIG. 2. The user interface 136 is configured to be installed onto, mounted on, or reside on the locomotive control stand 104. In this exemplary embodiment, the user interface 136 is configured to functionally replace the manual control of the locomotive brakes while the system is in operation.

Additionally, the user interface 136 is configured to provide the user with the ability to command an emergency brake application or a full service application with the push of a button in this exemplary embodiment. The user interface 136 is configured to implement a reset safety system where more than one action was required to release the independent brakes, in addition to providing LED feedback of brake pressure feedback and a textual status display.

In this exemplary embodiment, the user interface 136 includes increment/decrement toggle switch 160, reset button 162, independent brake rotary switch 164, penalty emergency (EMG) and full service (FS) buttons 166 and 168, status button 172, status display 174, and assisted/manual rotary switch 176.

The user interface 136 also includes train brake status LEDs 178 for indicating train brake status as release, minimum, light, medium, full, or emergency. In FIG. 3, the LED 178 is illuminated green to indicate that the train brake status is release.

The user interface 136 further includes independent brake status LEDs 180 for indicating independent brake status as release, low, medium, or full. Pressure setpoints for these settings are configurable, and the same functionality exists for independent brake setpoints, speed setpoints, and full service brake application sequence. In FIG. 3, the LED 180 is illuminated green to indicate that the indicate brake status is full.

Also, the user interface 136 further includes a multicolor LED 182 for indicating whether the system is in an assisted mode or manual mode of operation. In FIG. 3, the LED 182 is illuminated orange to indicate that the assisted mode of operation has been selected by the rotary switch 176. Accordingly, the transfer between manual controls and protection enabled controls will occur through the rotary switch 176, which may be similar to a standard locomotive isolation switch. The multicolor LED 182 indicates whether the system is in manual, has protection enabled or has protection active.

The train brake control of the user interface 136 includes increment/decrement function through a toggle switch 160 with LED feedback via LEDs 178. Incrementing train brake requires stopping in each step and reactivating the toggle switch 160. Releasing the train brake can be done by holding the toggle switch 160 in the 'Decrement' direction.

Independent brake control of the user interface 136 includes a rotary switch 164 for four preset independent brake levels including release, low, medium, and full. LED feedback is provided via LEDs 180. Activation of the reset pushbutton 162 within five seconds of commanding a release would be required when this system is active in this exemplary embodiment.

The user interface 136 also includes push button 166 for push button access to an emergency brake penalty. The user interface 136 further includes push button 168 for push button access to a controlled and configurable full service brake application.

The status display 174 is configured to provide textual information regarding the state of the protective system and can be used to retrieve predefined status information. Bell, horn, and sand commands may also be provided for manual usage from the locomotive control stand 104 while the system is active and can also be activated by the system when necessary.

Figure 4:
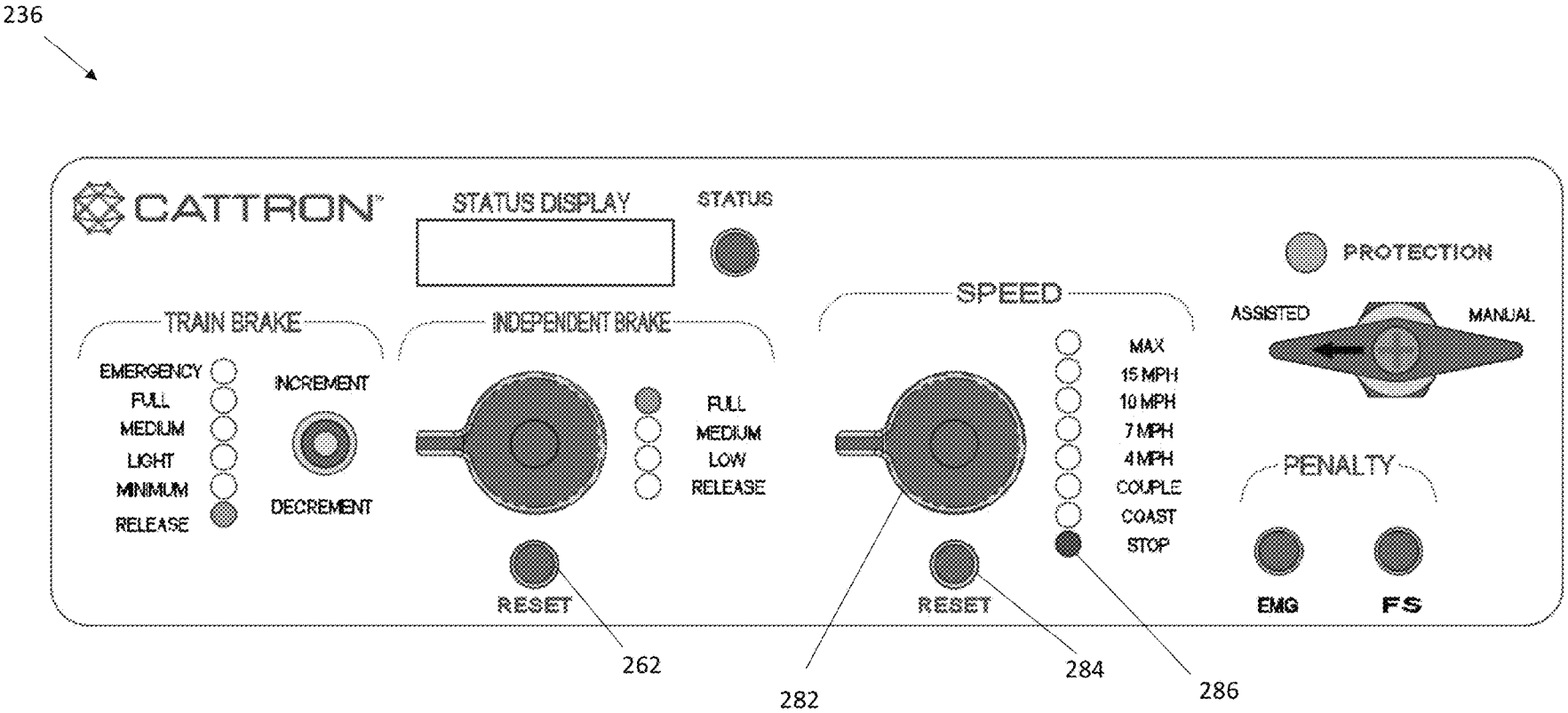
FIG. 4 illustrates a speed control version of a user interface that may be used with the locomotive functional safety system shown in FIG. 2 according to an alternative exemplary embodiment of the present disclosure.

FIG. 4 illustrates a speed control version of a user interface 236 that may be used with the locomotive functional safety system 132 shown in FIG. 2 according to an alternative exemplary embodiment of the present disclosure. Except for the addition of a speed control dial 282 and the disablement of the locomotive control stand throttle handle, the user interface 236 includes features similar or identical to the corresponding features of the user interface 136 shown in FIG. 3 and described above. Thus, the discussion of the similar or identical features will be abbreviated in this exemplary embodiment.

For the user interface 236 (FIG. 4), the throttle handle on the locomotive control stand 104 is disabled and replaced by the speed select dial 282 on the user interface 236.

Independent brake functionality on the user interface 236 may be provided for override purposes only, as the speed controller is configured to continuously adjust or modulate the independent brake to maintain the speed setpoint or selected speed, and to automatically set the independent brake to full when the locomotive stops or as part of a penalty.

To initiate a movement when the system is not in a penalty, the reset button 284 must be activated for at least one second followed by the movement of the speed select dial 282 from 'Stop' to the desired speed. In FIG. 4, the speed indicator LED 286 is illuminated red to indicate Stop.

A speed selection from 'Stop' to 'Coast' will permit independent brake release for the purpose of verifying that the brake cylinders are releasing and applying. But the system will require that the system is placed back to 'Stop' before a tractive effort command will be accepted.

A speed selection from any speed command to 'Coast' will force the system to coast to a stop. The system will respond to increases in speed by applying independent brake pressure.

In this example, the speed selection options are limited to 'Stop' plus seven speed selections—Coast, Couple, 4 MPH, 7 MPH, 10 MPH, 15 MPH, and Max. In other exemplary embodiments, the speed selections may be configurable or customizable. For example, Coast may be optional and replaced by another speed selection, e.g., 20 MPH, etc.

Also in this example, both reset buttons 262 and 282 have the same function and are duplicated for ergonomics and ease of access.

Example operator procedures will now be described for using a user interface (e.g., 136 (FIG. 3), 236 (FIG. 4), etc.) while operating a train in which is installed a locomotive functional safety system (e.g., system 132 in FIG. 2, etc.) according to exemplary embodiments disclosed herein.

An exemplary process for enabling the locomotive functional safety/protective system includes setting air brakes to trailing operation, removing brake handles (option), setting the mode switch to "Assisted", and performing emergency recovery procedure.

An exemplary process for disabling the locomotive functional safety/protective system includes setting the mode switch to "Assisted", replacing brake handles if previously removed, and setting air brakes to lead operation.

An emergency recovery procedure of the locomotive functional safety/protective system can only be performed in Assisted Mode and when the locomotive is stopped. This exemplary procedure includes incrementing the train brake setting to "Emergency", if not already active. Then, pressing the "Reset" button for about one second, then within five seconds holding the train brake switch down to release. Thereafter, confirmation of train brake release will be evident due to the train brake LEDs and status display.

A full service recovery procedure of the locomotive functional safety/protective system can only be performed in Assisted Mode and when the locomotive is stopped. This exemplary procedure includes incrementing the train brake setting to "Full", if not already active. Then pressing the "Reset" button for about one second, then within five seconds holding the train brake switch down to release. Thereafter, confirmation of train brake release will be evident due to the train brake LEDs and status display.

Regarding a process for releasing independent brake (throttle control systems), this process is required to release the independent brake once it is fully applied due to a locomotive stop event. This exemplary process includes moving the independent brake dial to "Full", pressing the "Reset" button for about one second, then within five seconds turning the independent brake dial to "Release".

Regarding a process for releasing independent brake (speed control systems), this process is required to command a speed from a stop. This exemplary process includes moving the Speed Select Dial to "Stop" if not already in "Stop", pressing the "Reset" button for about one second, then within five seconds turning the Speed Select Dial to desired speed.

In an exemplary embodiment, a system for increasing locomotive functional safety is configured for intercepting commands entered or input via manual controls of a locomotive control stand and/or user interface. The system is configured to allow a user (e.g., a locomotive engineer, etc.) to manually operate the locomotive via the manual controls in an assisted operation mode with built-in protections. The built-in protections may include one or more of Pullback Stopping Protection (PSP) protection, speed limiting, train brake cycle braking protection, etc. when the locomotive is being operating in the assisted operation mode. The system is configured to intercept commands (broadly, user input) from the manual locomotive controls and only relay those commands (e.g., to trainline signals, actuators, etc.) that are approved based on processing by safety functions predetermined in system firmware.

Exemplary embodiments disclosed herein may be configured to provide one or more (but not necessarily any or all) of the following safety enhancements for non-RCL (manual) locomotive operations without complete remote control adoption: Main Reservoir pressure monitoring and response, Independent and Train Brake feedback monitoring and response, Two-step command required for Independent Brake Release, Pushbutton Emergency application command, Pushbutton configurable Full Service command, Alerter function while operating in Assisted Mode, Configurable Train Brake Cycle Braking Protection, Configurable Rollback Protection, Configurable Wheel Slip detection and response, Configurable Independent Brakes Dragging warning and response, Configurable Train Brakes Dragging warning and response, Configurable Brake Pipe Reduction Slew Rate, Directional GPS Stop Zone, Grade Crossing Protection, and/or Fast Idle Charge Mode.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purposes of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected, or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A locomotive functional safety system comprising:

a memory to store computer-executable instructions; and a processor in communication with the memory to execute the computer-executable instructions, such that the locomotive functional safety system is configured to:

receive one or more manual control commands from a locomotive control stand and/or a user interface onboard a locomotive;

determine whether the one or more manual control commands pass or satisfy one or more predetermined criteria;

if the one or more manual control commands pass or satisfy the one or more predetermined criteria, approve the one or more manual control commands and allow the one or more manual control commands to be relayed onward and/or acted upon; and if the one or more manual control commands do not pass or satisfy the one or more predetermined criteria, disapprove the one or more manual control commands and disallow the one or more manual control commands to be relayed onward and/or acted upon.

2. The locomotive functional safety system of claim 1, wherein:

the locomotive functional safety system is configured to be installed onboard the locomotive generally between the locomotive control stand, a locomotive electrical system, and a locomotive brake system;

the locomotive functional safety system is configured to:

intercept one or more manual control commands for the locomotive electrical system and/or the locomotive brake system that are manually input by a user via the locomotive control stand and/or the user interface;

interpret the one or more manual control commands to determine whether the one or more manual control commands pass or satisfy the one or more predetermined criteria;

if the one or more manual control commands pass or satisfy the one or more predetermined criteria, approve the one or more manual control commands and allow the one or more manual control commands to be relayed onward to the locomotive electrical system and/or the locomotive brake system; and if the one or more manual control commands do not pass or satisfy the one or more predetermined criteria, disapprove the one or more manual control commands and disallow the one or more manual control commands to be relayed onward to the locomotive electrical system and/or the locomotive brake system.

3. The locomotive functional safety system of claim 2, wherein the one or more predetermined criteria comprise firmware functions that regulate safety, and wherein:

the locomotive functional safety system is configured to send electrical system command data to the locomotive electrical system along a communication pathway when the electrical system command data passes or satisfies the firmware functions that regulate safety; and/or the locomotive functional safety system is configured to send brake system command data to the locomotive brake system along a communication pathway when the brake system command data passes or satisfies the firmware functions that regulate safety.

4. The locomotive functional safety system of claim 1, wherein the locomotive functional safety system is configured to rely on sensor data from one or more sensors when determining whether the one or more manual control commands pass or satisfy one or more predetermined criteria.

5. The locomotive functional safety system of claim 4, wherein:

the locomotive functional safety system is configured to receive the sensor data from the one or more sensors via a communication pathway; and/or the one or more sensors comprise one or more sensors that provide data relating to air pressure, air flow, speedometer, digital inputs, analog inputs, GNSS, RFID, geofences, track transponders, internally stored digital maps, intelligent video, and/or signals used to enact a declining speed limit to force a stop prior to a protected location.

6. The locomotive functional safety system of claim 1, wherein the locomotive functional safety system is configured to:

receive the one or more manual control commands manually input by a locomotive engineer or other user via the locomotive control stand and/or the user interface; and apply one or more rules and safety functions to determine which of the one or more manual control commands are relayed onward and which of the one more manual control commands are not relayed onward.

7. The locomotive functional safety system of claim 1, wherein:

the one or more predetermined criteria comprise firmware functions that regulate safety;

the locomotive functional safety system is configured to:

receive the one or more manual control commands manually input by a locomotive engineer or other user via the locomotive control stand and/or the user interface; and act only on manual control commands that pass the firmware functions that regulate safety.

8. The locomotive functional safety system of claim 1, wherein:

the locomotive functional safety system includes and/or communicates with the user interface; and/or the user interface is installed onto, mounted on, or resides on the locomotive control stand.

9. The locomotive functional safety system of claim 1, wherein the locomotive functional safety system includes one or more input/output (I/O) subsystems, one or more processing subsystems, and one or more Industrial Internet of Things subsystems.

10. The locomotive functional safety system of claim 1, wherein the locomotive functional safety system includes a cutover subsystem, an input subsystem, a processing subsystem, an output subsystem, and a self-monitoring subsystem.

11. The locomotive functional safety system of claim 10, wherein:

the cutover subsystem is configured to be installed to remove direct control from the locomotive control stand including electric/electronic control stand signals and pneumatic or electronic brake system and to thereby route control through the locomotive functional safety system;

the input subsystem is configured to read user inputs from the user interface, electric/electronic signals from the locomotive control stand, and digital inputs and analog inputs indicating the state of various user input and feedback points on the locomotive, the input subsystem configured to forward inputs to the processing subsystem;

the processing subsystem includes safety overrides, firmware functions, and watchdogs to read various inputs and to validate and process the various inputs through various rules based on user input, system location, feedback data, and predetermined configuration settings, the processing subsystem configured to store inputs, outputs, and system events in an archive, the processing subsystem configured to deteimine which one or more manual control commands can be relayed onward and/or or acted upon while complying with the safety rules established for the locomotive functional safety system;

the output subsystem is configured to receive approved output commands from the processing subsystem and to activate electrical, electronic, pneumatic, or mechanical actuators in accordance with the approved output commands from the processing subsystem; and the self-monitoring subsystem is configured to monitor the health of the complete locomotive functional safety system and the health of parts of the complete locomotive, whereby the locomotive functional safety system is operable for monitoring functions for correspondence that would otherwise require observation by a locomotive engineer for detection.

12. The locomotive functional safety system of claim 11, wherein the locomotive functional safety system further comprises a subsystem configured to send recorded archive data from the locomotive functional safety system to a remote server for data aggregation and/or data reporting.

13. The locomotive functional safety system of claim 1, wherein the locomotive functional safety system is usable onboard a locomotive not completely equipped with remote control locomotive (RCL) operation, whereby the locomotive functional safety system is operable for increasing functional safety by enabling implementation and/or incorporation of one or more safety and productivity features of RCL systems on the locomotive not completely equipped with RCL operation.

14. The locomotive functional safety system of claim 1, wherein:

the locomotive functional safety system is configured for implementing and/or incorporating one or more of Pullback Stopping Protection (PSP), speed limiting, and/or train brake cycle braking protection; and/or the locomotive functional safety system is configured for selectively limiting throttle commands input by the user from being relayed onward and/or by applying braking effort that is not commanded by the user with respect to the speed feedback.

15. The locomotive functional safety system of claim 1, wherein:

the locomotive functional safety system is configured to intercept manual control commands output from the locomotive control stand via one or more one-way communication pathways; and the locomotive functional safety system is configured to intercept manual control commands output from the user interface via one or more two-way communication pathways.

16. The locomotive functional safety system of claim 1, wherein the locomotive functional safety system includes the user interface configured to be installed onto, mounted on, or reside on the locomotive control stand, and wherein:

the user interface is configured to functionally replace a locomotive brakes manual control of the locomotive control stand while the locomotive functional safety system is in operation; or the user interface is configured to functionally replace a locomotive throttle manual control of the locomotive control stand that is disabled while the locomotive functional safety system is in operation.

17. A locomotive comprising a locomotive control stand, a user interface, a locomotive electrical system, a locomotive brake system, and the locomotive functional safety system of claim 1 installed onboard the locomotive generally between and in communication with the locomotive control stand, the locomotive electrical system, and the locomotive brake system, the locomotive functional safety system is configured to:

intercept one or more manual control commands for the locomotive electrical system and/or the locomotive brake system that are manually input by a user via the locomotive control stand and/or the user interface;

interpret the one or more manual control commands to determine whether the one or more manual control commands pass or satisfy the one or more predetermined criteria;

if the one or more manual control commands pass or satisfy the one or more predetermined criteria, approve the one or more manual control commands and allow the one or more manual control commands to be relayed onward to the locomotive electrical system and/or the locomotive brake system; and if the one or more manual control commands do not pass or satisfy the one or more predetermined criteria, disapprove the one or more manual control commands and disallow the one or more manual control commands to be relayed onward to the locomotive electrical system and/or the locomotive brake system.

18. The locomotive of claim 17, wherein:

the locomotive functional safety system is configured to have direct control over one or more of a trainline throttle, a reverser, generator field signals, and trainline pneumatic lines; and/or the locomotive control stand comprises engine functional controls, brake functional controls, throttle control, reverser, radio controls, light controls, and/or multiple displays.

19. A locomotive system comprising:

a locomotive control stand including manual controls for allowing a user to manually operate the locomotive;

a locomotive electrical system;

a locomotive brake system; and a locomotive functional safety system generally between and in communication with the locomotive control stand, the locomotive electrical system, and the locomotive brake system, the locomotive functional safety system is configured to:

intercept one or more manual control commands for the locomotive electrical system and/or the locomotive brake system that are manually input via the manual controls of the locomotive control stand and/or via a user interface;

interpret the one or more manual control commands to determine whether the one or more manual control commands pass or satisfy one or more predetermined criteria;

if the one or more manual control commands pass or satisfy the one or more predetermined criteria, approve the one or more manual control commands and allow the one or more manual control commands to be relayed onward to the locomotive electrical system and/or the locomotive brake system; and if the one or more manual control commands do not pass or satisfy the one or more predetermined criteria, disapprove the one or more manual control commands and disallow the one or more manual control commands to be relayed onward to the locomotive electrical system and/or the locomotive brake system.

20. The locomotive system of claim 19, further comprising a user interface configured to be installed onto, mounted on, or reside on the locomotive control stand, and wherein:

the user interface is configured to functionally replace a locomotive brakes manual control of the locomotive control stand while the locomotive functional safety system is in operation; or the user interface is configured to functionally replace a locomotive throttle manual control of the locomotive control stand that is disabled while the locomotive functional safety system is in operation.

21. The locomotive system of claim 19, wherein the one or more predetermined criteria comprise firmware functions that regulate safety, and wherein:

the locomotive functional safety system is configured to send electrical system command data to the locomotive electrical system along a communication pathway when the electrical system command data passes or satisfies the firmware functions that regulate safety; and/or the locomotive functional safety system is configured to send brake system command data to the locomotive brake system along a communication pathway when the brake system command data passes or satisfies the firmware functions that regulate safety.

22. The locomotive system of claim 19, wherein the locomotive functional safety system is usable onboard a locomotive not completely equipped with remote control locomotive (RCL) operation, whereby the locomotive functional safety system is operable for increasing functional safety by enabling implementation and/or incorporation of one or more safety and productivity features of RCL systems on the locomotive not completely equipped with RCL operation.

23. The locomotive system of claim 19, wherein:

the locomotive functional safety system is configured for implementing and/or incorporating one or more of Pullback Stopping Protection (PSP), speed limiting, and/or train brake cycle braking protection; and/or the locomotive functional safety system is configured for selectively limiting throttle commands input by the user from being relayed onward and/or by applying braking effort that is not commanded by the user with respect to speed feedback.

24. A method for increasing functional safety of a locomotive, the method comprising:

allowing a user to manually operate the locomotive via manual locomotive controls in an assisted operation mode with built-in protections, the built-in protections including one or more of Pullback Stopping Protection (PSP) protection, speed limiting, and train brake cycle braking protection when the locomotive is being operating in the assisted operation mode; and intercepting commands from the manual locomotive controls and only relaying and/or acting on commands that are approved based on processing by safety functions predetermined in firmware.

* * * * *